US009058051B2

(12) United States Patent
Miura et al.

(10) Patent No.: US 9,058,051 B2
(45) Date of Patent: Jun. 16, 2015

(54) GRIP

(75) Inventors: Keisuke Miura, Izumisano (JP); Masaaki Ueda, Sakai (JP); Ikuhiro Uotani, Sakai (JP); Kenji Kohno, Kawachinagano (JP); Takehiro Sakai, Sakai (JP)

(73) Assignee: Kubota Corporation, Osaka (JP)

( * ) Notice: Subject to any disclaimer, the term of this patent is extended or adjusted under 35 U.S.C. 154(b) by 643 days.

(21) Appl. No.: 12/870,951

(22) Filed: Aug. 30, 2010

(65) Prior Publication Data

US 2011/0048162 A1 Mar. 3, 2011

(30) Foreign Application Priority Data

Aug. 31, 2009 (JP) ..... 2009-200151

(51) Int. Cl.
*G05G 1/06* (2006.01)
*G05G 9/047* (2006.01)

(52) U.S. Cl.
CPC ..... *G05G 1/06* (2013.01); *Y10T 74/20612* (2015.01); *G05G 2009/04774* (2013.01)

(58) Field of Classification Search
CPC ..... G05G 1/06; E02F 9/2004
USPC ..... 74/335, 523; D15/28; D14/412, 114; 73/862.541; 180/333; 414/685; 273/148 B; D12/179, 345
IPC ..... A63F 13/06
See application file for complete search history.

(56) References Cited

U.S. PATENT DOCUMENTS 1,591,433 A * 7/1926 Pommer ..... 16/430
D300,023 S * 2/1989 DeRamus, Jr. ..... D14/179
5,042,314 A * 8/1991 Rytter et al. ..... 74/335
D327,674 S * 7/1992 Kuo ..... D14/412
5,558,329 A * 9/1996 Liu ..... 273/148 B
D450,702 S * 11/2001 Sagawa et al. ..... D14/412
6,425,729 B1 * 7/2002 Coutant ..... 414/685
6,571,427 B2 * 6/2003 Agate et al. ..... 16/441
6,741,233 B1 * 5/2004 Swan et al. ..... 345/161

(Continued)

FOREIGN PATENT DOCUMENTS

CA 2495724 * 1/2004 ..... E02F 9/24
JP 3069549 U 6/2000

(Continued)

*Primary Examiner* — Vinh Luong
(74) *Attorney, Agent, or Firm* — The Webb Law Firm

(57) ABSTRACT

A grip comprises a grip body forming a gripping control portion of a manually operable device to be held with the operator's palm and fingers. The grip body includes a ball-receiving surface coming into contact with the ball of the thumb, a palm-receiving surface coming into contact with a middle portion of the palm and the ball of the little finger, a finger-receiving surface coming into contact with the fingers, an open surface positioned between the tips of the fingers and the ball of the thumb for receiving the thumb when the grip body is held, and a switch mounted on a top portion of the grip body to be operable with the thumb. The grip body further comprises a thumb-guiding portion in the form of a shallow groove formed at an upper part of the ball-receiving surface of the grip body, the inside of the first joint of the thumb being placed along the thumb-guiding portion when the switch is operated, and a rising portion formed on at least either one of portions between the thumb-guiding surface and the open surface and between the thumb-guiding surface and the palm-receiving surface for applying resistance when the operator's hand advances into the switch.

10 Claims, 9 Drawing Sheets

(56) References Cited

U.S. PATENT DOCUMENTS

| | | | | |
|---|---|---|---|---|
| 7,334,658 | B2 * | 2/2008 | Berg et al. | 180/333 |
| RE40,324 | E * | 5/2008 | Crawford | 345/157 |
| 7,409,879 | B2 * | 8/2008 | Glatz | 73/862.541 |
| D633,111 | S * | 2/2011 | Muraoka et al. | D15/28 |
| D635,155 | S * | 3/2011 | Blind | D15/28 |
| D636,306 | S * | 4/2011 | Pohanka | D12/179 |
| 7,999,790 | B2 * | 8/2011 | Scott | 345/161 |
| D645,046 | S * | 9/2011 | Hobenshield et al. | D14/412 |
| 2002/0157498 | A1 * | 10/2002 | Black | 74/524 |
| 2005/0279561 | A1 * | 12/2005 | Shearer et al. | 180/333 |
| 2013/0074645 | A1 * | 3/2013 | Hakansson et al. | 74/523 |
| 2015/0035658 | A1 * | 2/2015 | Provancher et al. | 340/407.1 |

FOREIGN PATENT DOCUMENTS

| | | | | |
|---|---|---|---|---|
| JP | 2005-102821 | A | 5/2005 | |
| JP | 2008-247235 | A | 10/2008 | |
| JP | 2008293899 | A | 12/2008 | |
| WO | WO 2009/048364 | A1 * | 4/2009 | E02F 9/20 |
| WO | WO 2012/154188 | A1 * | 11/2012 | E01H 4/02 |

* cited by examiner

GRIP

TECHNICAL FIELD OF THE INVENTION

The present invention relates to a grip forming a gripping control portion of a manually operable device of an industrial machine.

BACKGROUND ART

An example of a grip forming a gripping control portion of a manually operable device of an industrial machine is disclosed in Japanese Unexamined Patent Application Publication No. 2008-293899. More particularly, the grip comprises a grip body that is held with the operator's palm and fingers, a switch mounted on a top portion of the grip body to be operable with the thumb, and a push button provided in a front upper portion of the grip body to be operable with the operator's first finger or second finger, the grip body including a ball-receiving surface coming into contact with the ball of the thumb, a palm-receiving surface coming into contact with a middle portion of the palm and the ball of the little finger, a finger-receiving surface coming into contact with the fingers, and an open surface positioned between the tips of the fingers and the ball of the thumb for receiving the thumb when the grip body is held.

SUMMARY OF THE INVENTION

According to the invention disclosed in the above-noted publication, since the ball-receiving surface of the grip body defines a flat arc surface, the position of the thumb remains insecure when the operator holds the grip to operate the switch. In addition, the thumb may advance into the switch inadvertently (or violate a border of a switching operational range) or the operator's palm may cover the top portion of the grip body to advance into the side of the switch when the grip is held. This does not necessarily provide good operability.

The present invention has been made having regard to the above-noted drawbacks of the conventional art, and its object is to provide a grip having good operability.

A grip according to the present invention comprises:

a grip body forming a gripping control portion of a manually operable device to be held with the operator's palm and fingers, the grip body including:

- a ball-receiving surface coming into contact with the ball of the thumb;
- a palm-receiving surface coming into contact with a middle portion of the palm and the ball of the little finger;
- a finger-receiving surface coming into contact with the fingers;
- an open surface positioned between the tips of the fingers and the ball of the thumb for receiving the thumb when the grip body is held; and
- a switch mounted on a top portion of the grip body to be operable with the thumb, wherein the grip body further comprises a thumb-guiding portion in the form of a shallow groove formed at an upper part of the ball-receiving surface of the grip body, the inside of the first joint of the thumb being placed along the thumb-guiding portion when the switch is operated, and a rising portion formed on at least either one of portions between the thumb-guiding surface and the open surface and between the thumb-guiding surface and the palm-receiving surface for applying resistance when the operator's hand advances into the switch.

In the above-noted arrangement, it is preferable that the switch is formed as a seesaw-type switch, a first rising portion is formed between the thumb-guiding portion and the open surface for applying resistance when the operator's hand advances into the switch, a second rising portion is formed between the thumb-guiding portion and the palm-receiving surface for applying resistance when the operator's hand advances into the switch, and a distance between a first ridge of the first rising portion and a second ridge of the second rising portion is gradually increased from lower parts of the ridges toward the switch.

In the above-noted arrangement, it is preferable that the first ridge adjacent to the open surface is in the form of a generally straight line while the second ridge adjacent to the palm-receiving surface is in the form of an outward bulging arc line extending laterally outside to a greater extent in an upper part than in a lower part of the ridge.

In the above-noted arrangement, it is preferable that the distance between the first ridge and the second ridge at the upper part thereof is greater than a lateral width of a control element of the switch.

In the above-noted arrangement, it is preferable that a flat surface is formed on the top portion of the grip body to surround the switch, and wherein the switch includes a switch case that assumes a front-side upward oriented-inclining posture in which a surface of the switch case projects from the flat surface to a greater extent at the front side thereof than at the near side of the operator.

In the above-noted arrangement, it is preferable that the top portion of the grip body includes an area defined around the flat surface to have a generally spherical surface, and the surface of the switch case of the switch is positioned within a globe of the generally spherical surface.

In the above-noted arrangement, it is preferable that the grip body has a lateral width that becomes gradually greater at an upper part than at a lower part thereof, the palm-receiving surface has a middle portion receiving area that bulges from a little finger ball receiving area to a great extent, and a distance extending from a lateral center line of the grip body to the middle portion receiving area is greater than a distance extending from the center line to the open surface.

In the above-noted arrangement, it is preferable that the finger-receiving surface of the grip body has an upper part bulging forward to a greater extent than a lower part thereof, and is provided with a push button at the upper part thereof that is operable with the first finger or second finger, and a fort portion is formed around the push button that has substantially the same height as a pressing surface of the push button.

In the above-noted arrangement, it is preferable that the fort portion has an arc shape to open downward with a lower part thereof being continuous with the lower part of the finger-receiving surface through a recessed arc surface.

According to the present invention, it is possible to prevent the switch from being erroneously operated by guiding the thumb with the inside of the first joint of the thumb being placed along the upper part of the ball-receiving surface of the grip body, and by applying resistance against the operator's hand that is about to advance into the switch.

DETAILED DESCRIPTION OF THE INVENTION

The present invention will be described hereinafter in reference to the accompanying drawings.

Figure 1:
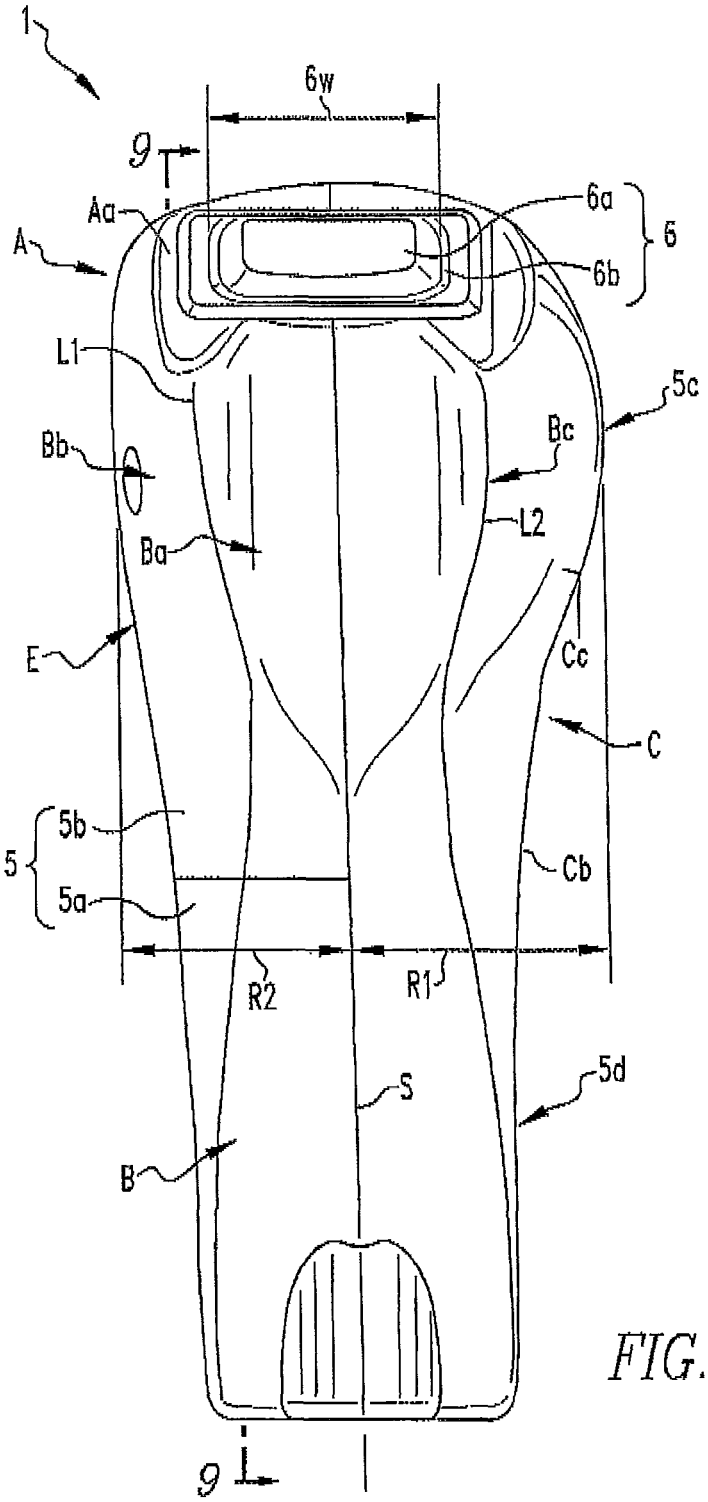
FIG. 1 is a front view of a grip of the present invention.
Figure 2:
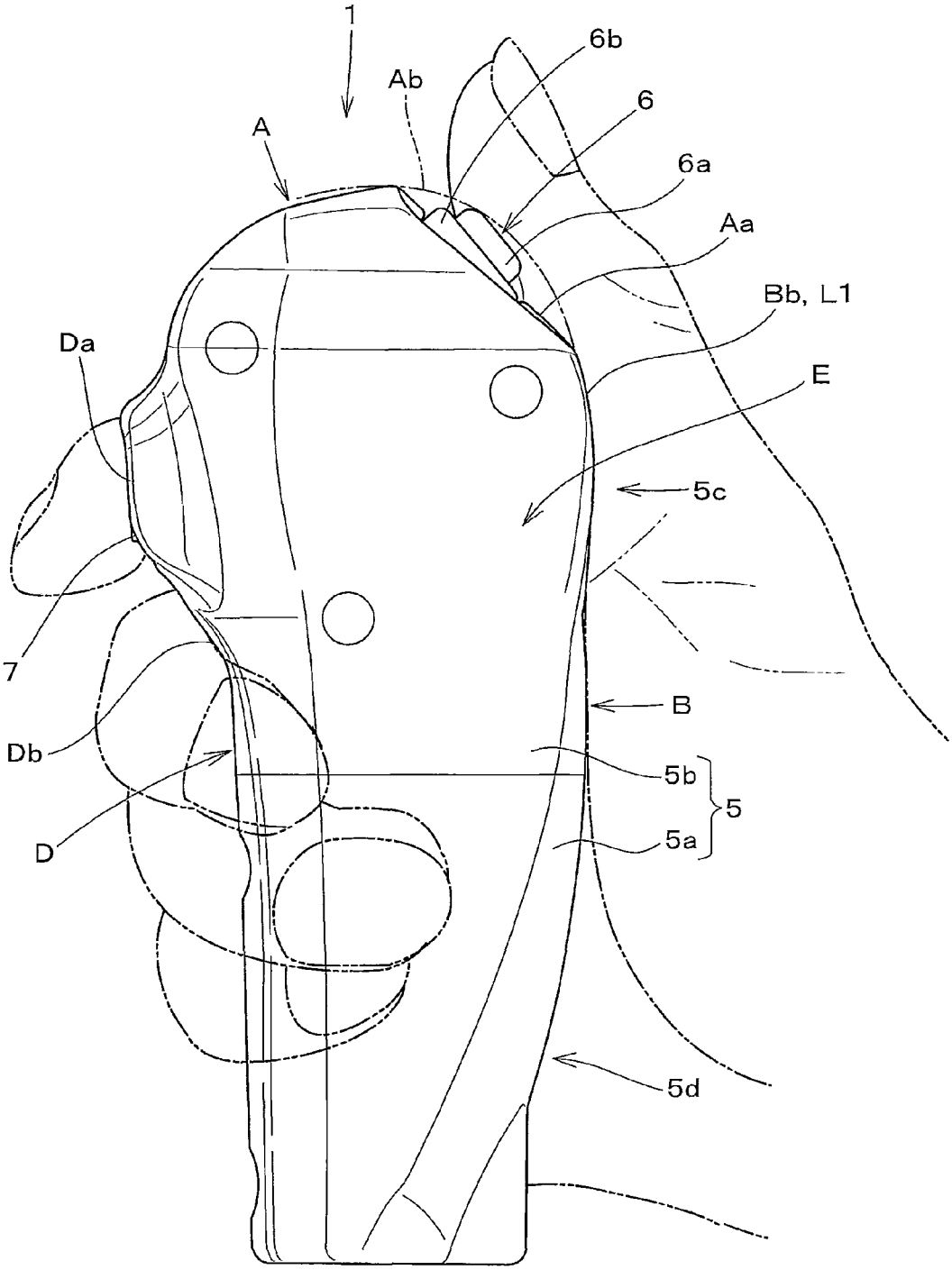
FIG. 2 is a left side view of the grip.
Figure 3:
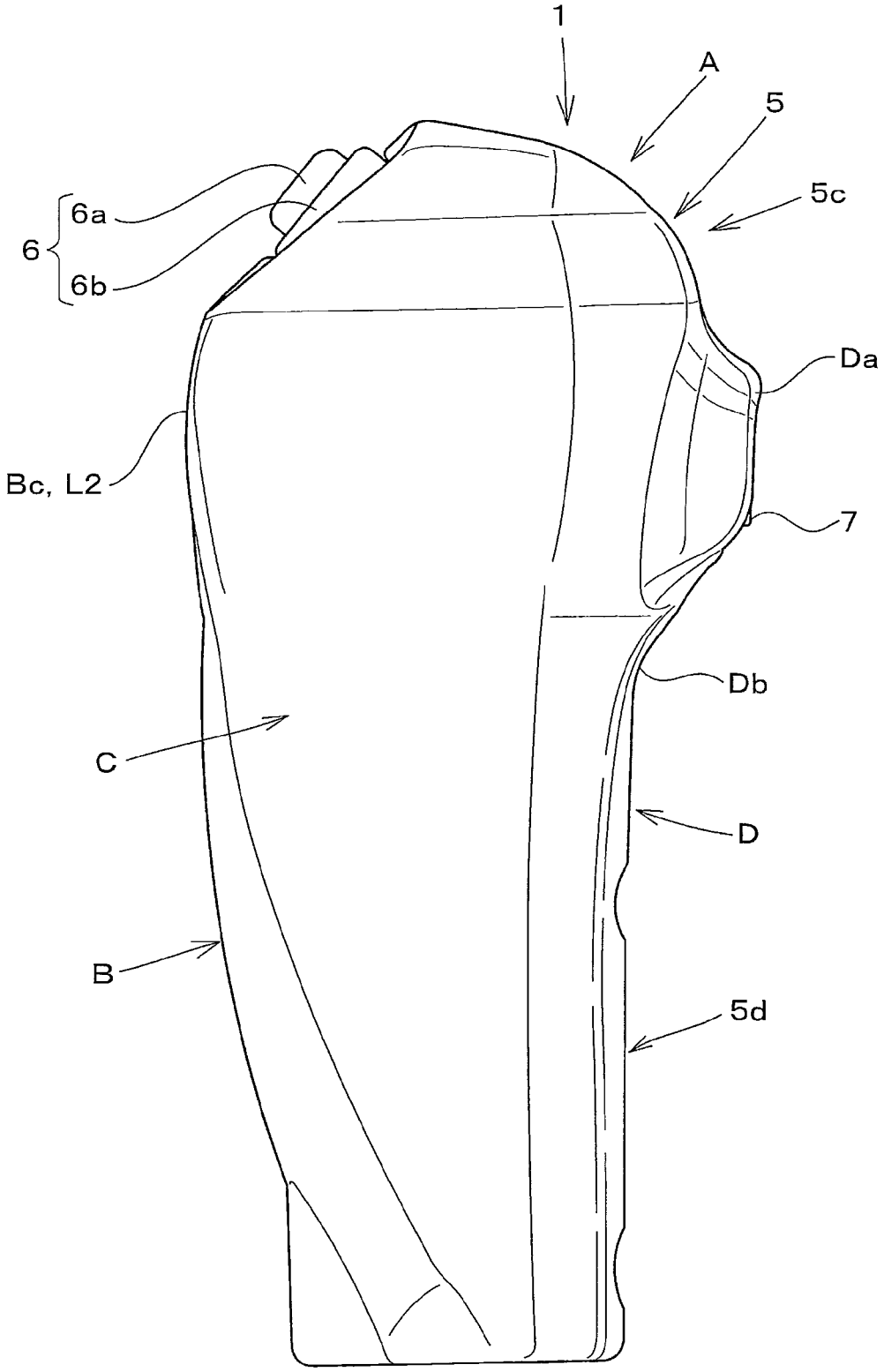
FIG. 3 is a right side view of the grip.
Figure 4:
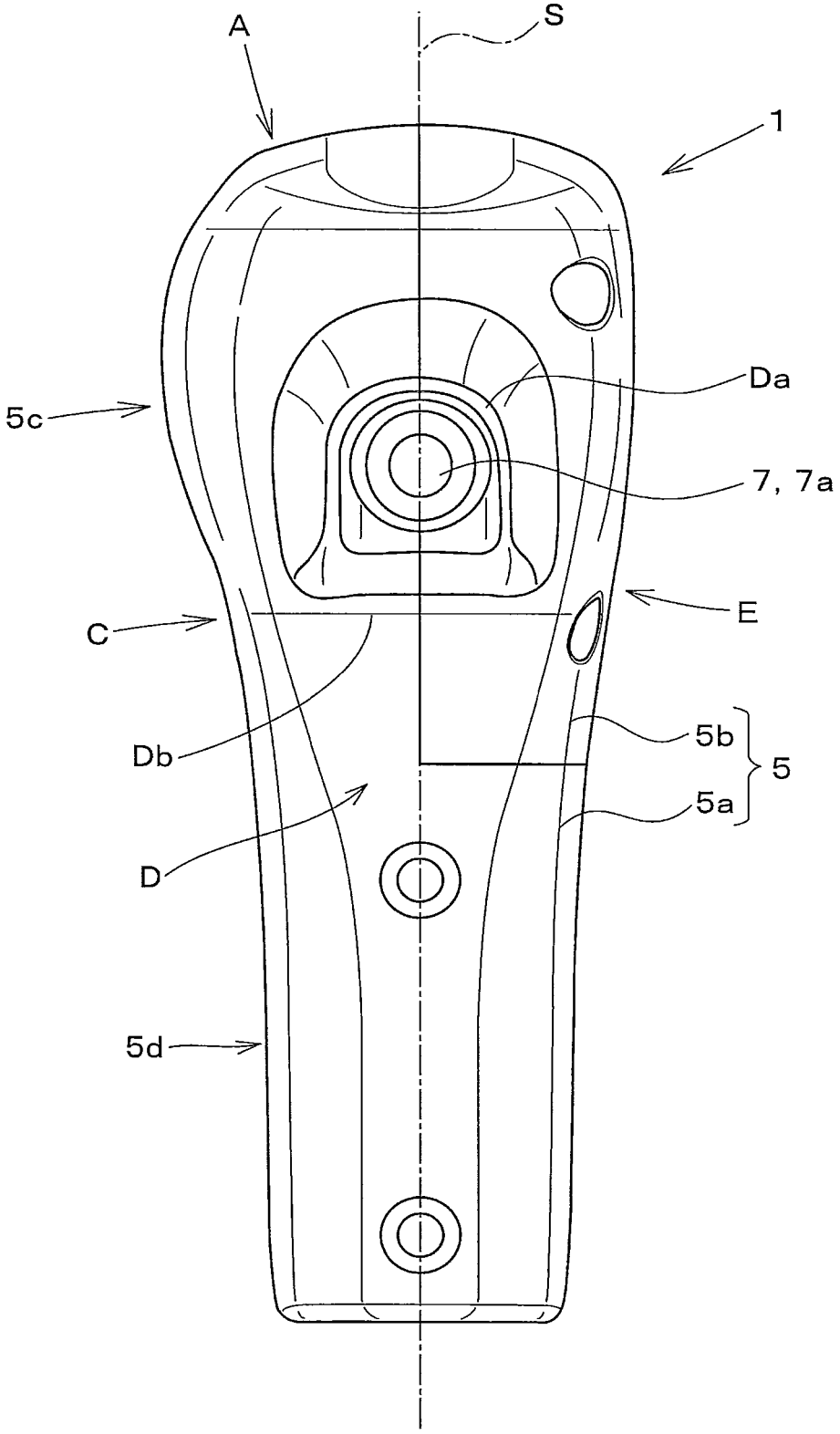
FIG. 4 is a rear view of the grip.
Figure 5:
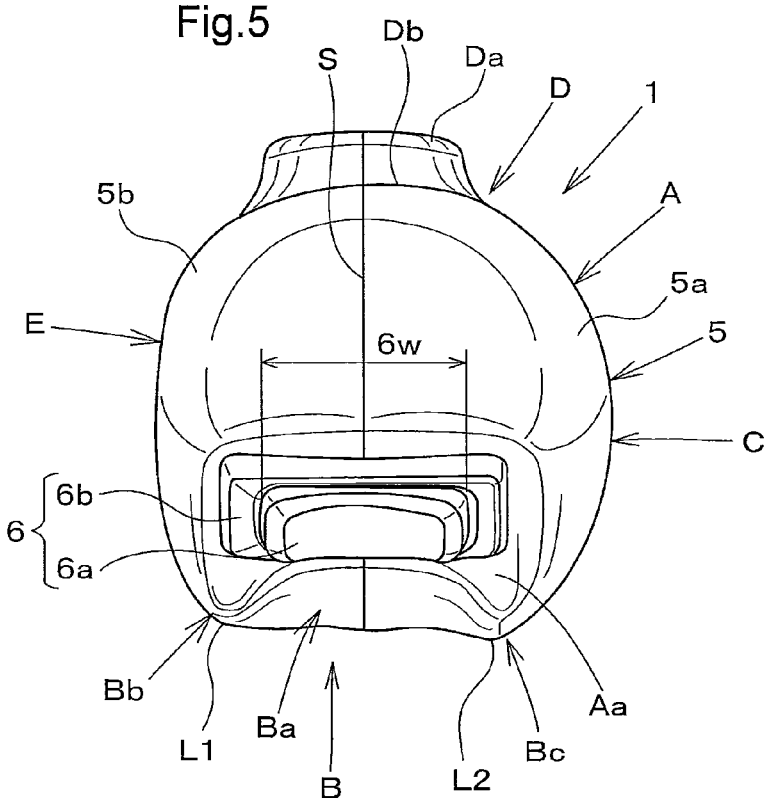
FIG. 5 is a top plan view of the grip.
Figure 6:
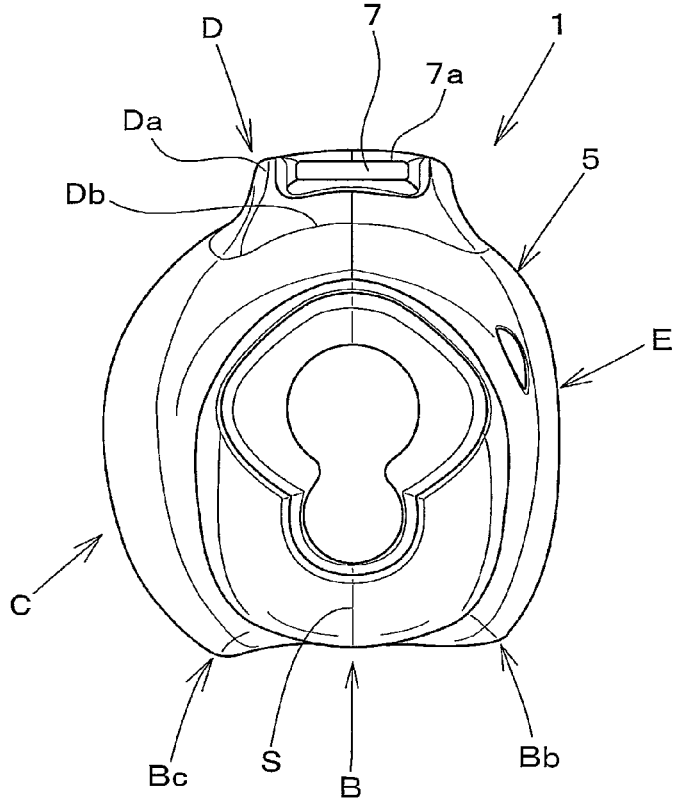
FIG. 6 is a bottom view of the grip.
Figure 7:
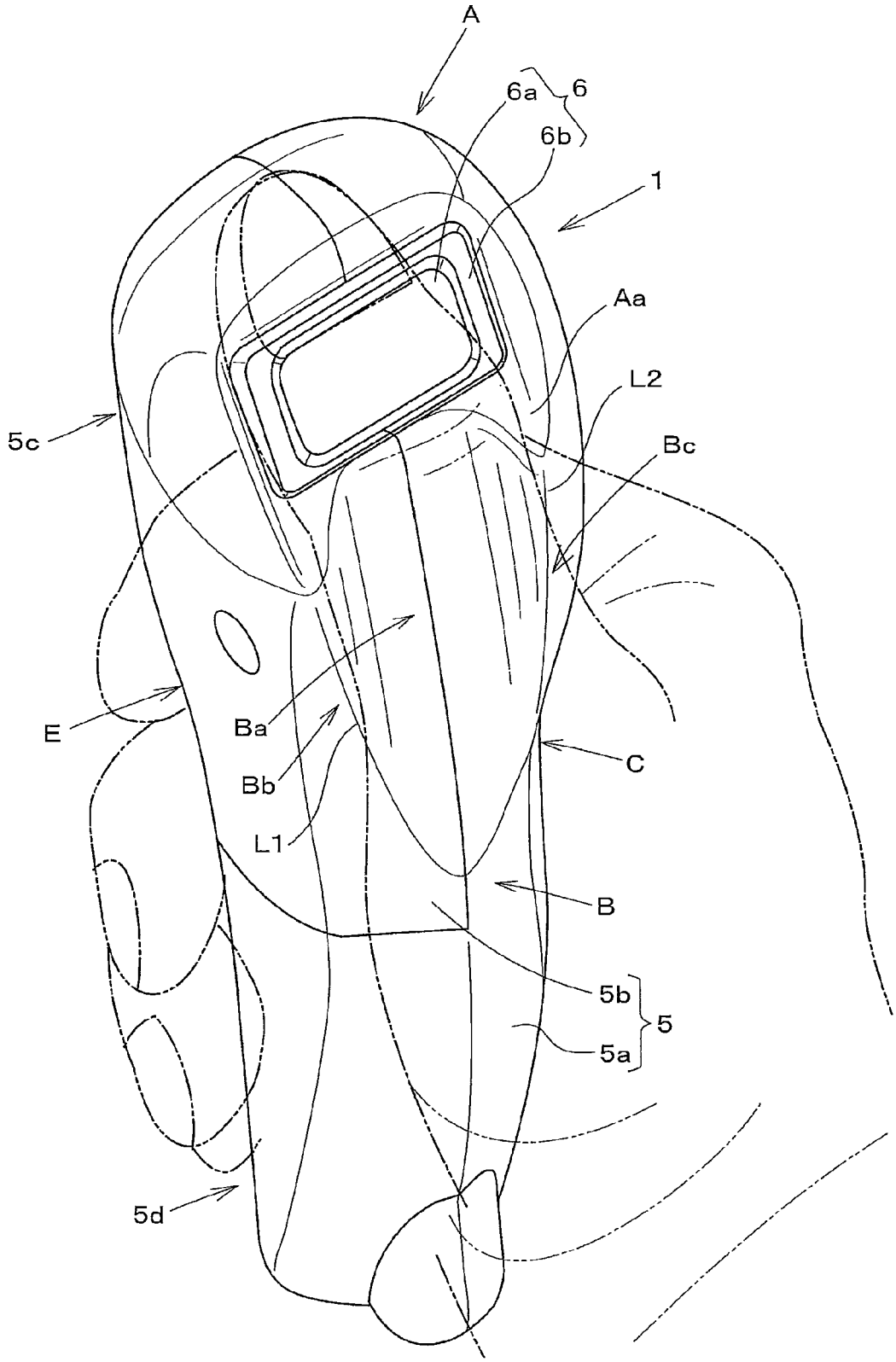
FIG. 7 is an upper-left perspective view of the grip.
Figure 8:
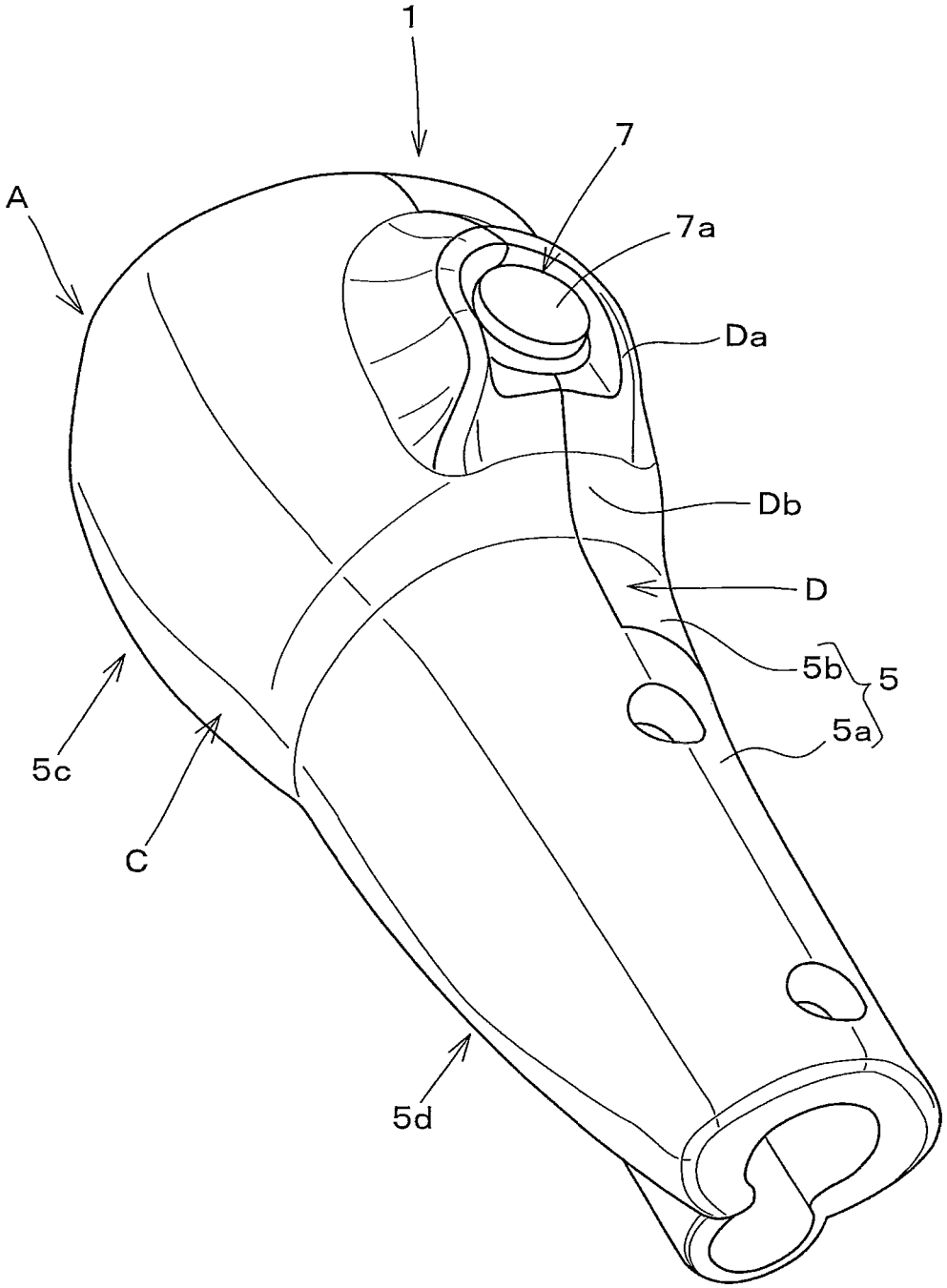
FIG. 8 is a lower-right perspective view of the grip.
Figure 9:
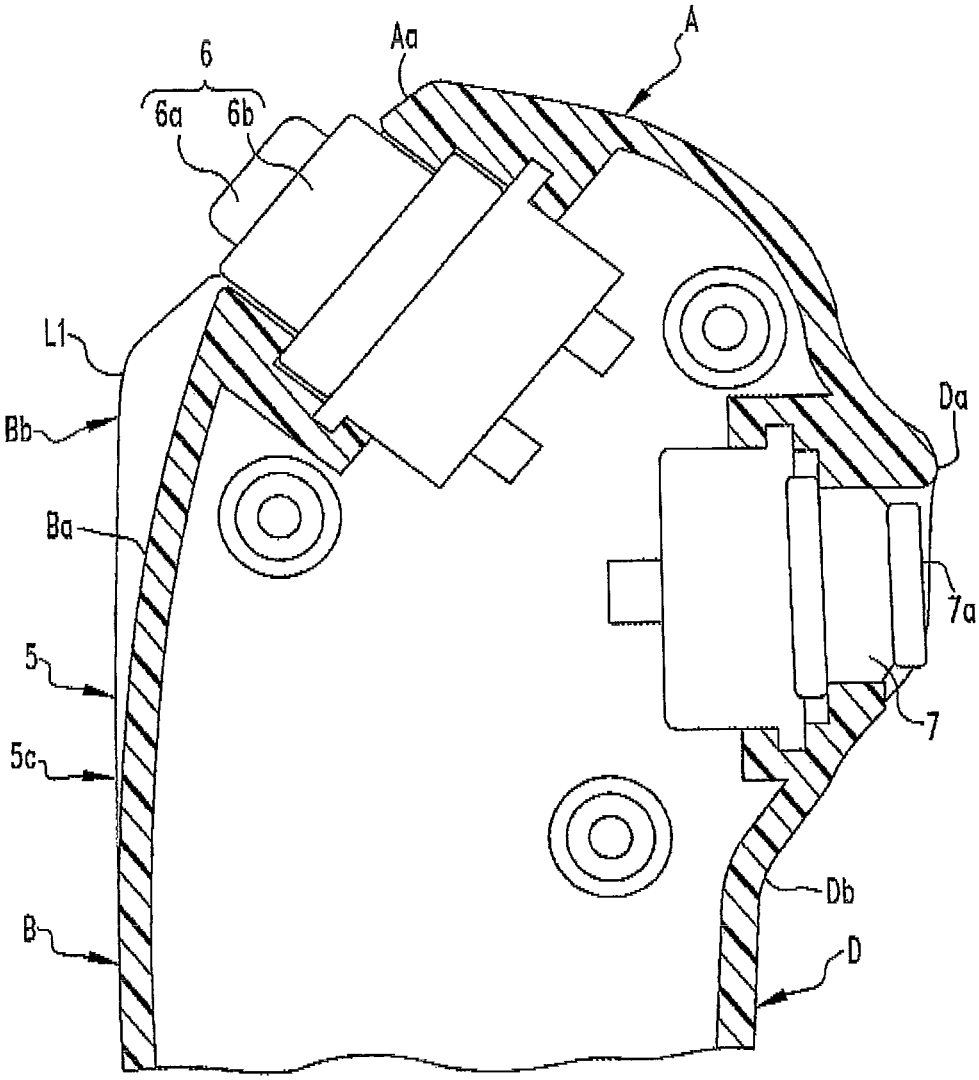
FIG. 9 is a cross sectional view taken along line 9-9 of FIG. 1 of an upper half of the grip.
Figure 10:
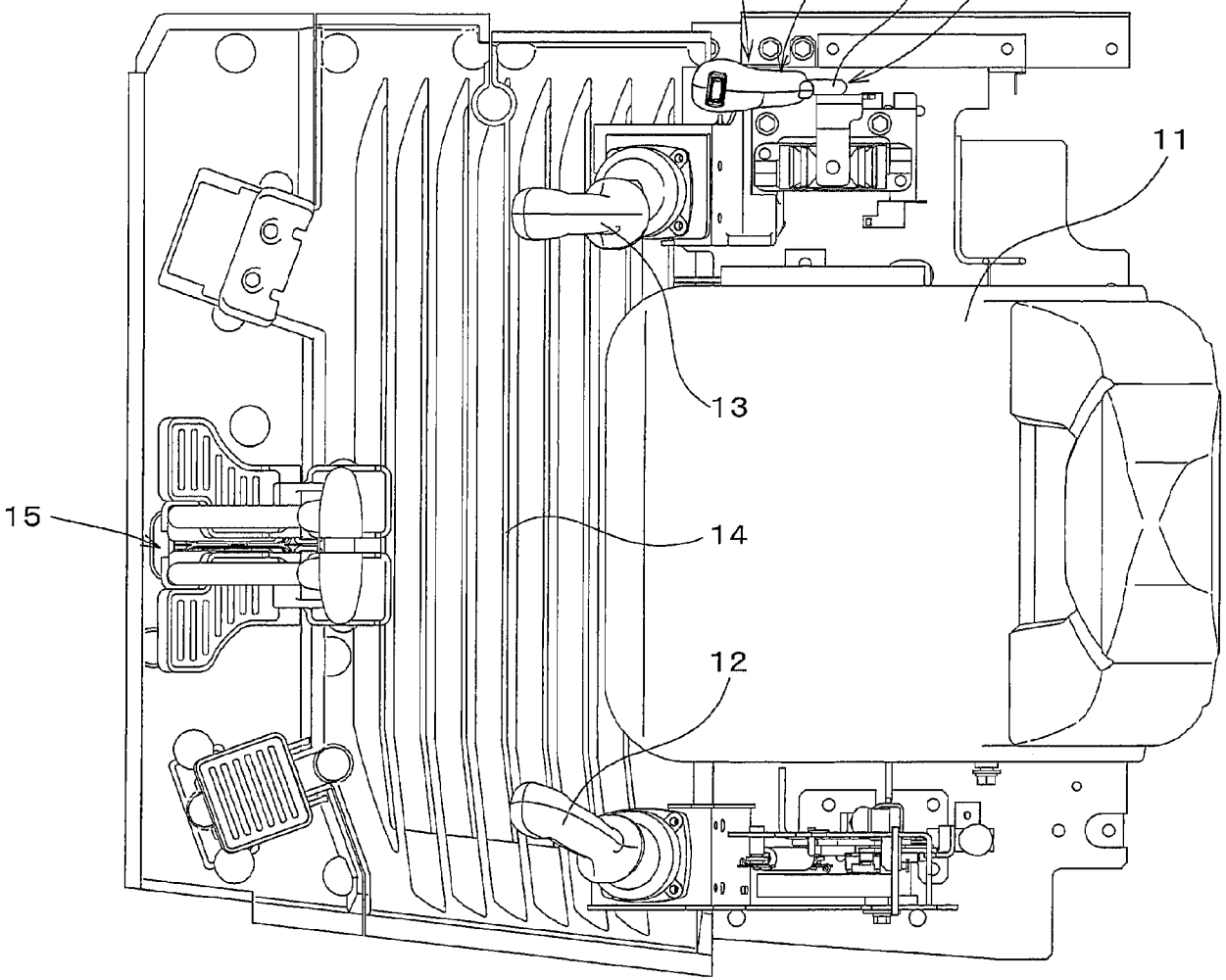
FIG. 10 is a top plan view of a driver's section of a backhoe when the grip is applied to a manually operable device of the backhoe.

FIG. 10 shows a driver's section of a backhoe as an example of industrial machines. The driver's section includes a driver's seat 11, a manually operable device (control lever) 2 provided in a forward right side part of the driver's seat 11 for actuating a blade of a dozer apparatus, and a grip 1 mounted on the manually operable device 2 to form a gripping control portion 3.

The manually operable device 2 including the grip 1 attached to an upper end of a lever rod 2*a* is adapted to move the blade of the dozer apparatus vertically by being pivotally operated in a fore-and-aft direction, to change the angle of the blade (to allow the blade to move back and forth at the right or left side thereof) by pressing a switch provided at a top portion of the grip with the operator's thumb, and to switch a traveling speed of the backhoe between "high" and "low" by pressing a push button provided at a rear side of the grip (or front side with reference to the backhoe) with the operator's first finger.

In FIG. 10, the driver's section further includes control devices 12 and 13 for working implements provided at lateral opposite sides of the driver's seat 11, a steering device 15 provided at a front portion of a floorboard 14 and the like.

FIGS. 1 to 9 show the grip 1 including a grip body 5 held with the palm and the fingers (first, second, third and little fingers) of the operator's hand, a seesaw-type switch 6 provided at a top portion A of the grip body 5 to be operable with the thumb, and a push button 7 provided at an upper front portion of the grip body 5 to be operable with the first finger or second finger.

The grip 1 as shown is for the right-hand use. The grip body 5 is made of synthetic resin and includes a base part 5*a* forming a lower portion and an upper right portion of the grip body that are integral with each other as one piece and a divided part 5*b* forming an upper left portion of the grip body. The base part 5*a* and the divided part 5*b* are combined with and screwed to each other at a center line S to hold the switch 6 and the push button 7 therebetween.

The grip body 5 has a head-bulb and trunk-circular shape including a generally spherical head portion 5*c* having the top portion A, and a trunk portion 5*d* having a circular shape with a diameter smaller than the diameter of the head portion 5*c*. The head portion 5*c* is accessible by the thumb and the first finger while the switch 6 provided at the top portion A is accessible by the tip of the thumb with the trunk portion 5*d* being gripped with the palm and the second finger.

The right position to hold the grip body 5 depends on the size of the operator's hand, but generally corresponds to a position where the inside of the thumb extending from the first joint to the tip is placed on the switch 6. In this state, the thumb and fingers are rounded to hold the grip with the palm being placed on the trunk portion 5*d*. The upper part of the palm and the base of the first finger just reach the head portion 5*c*.

The grip body 5 is shaped based on ergonomics so as to be held most easily at the right position to give the operator a sense of fittingness, or a feeling that each part of the hand comfortably fits to the grip. On the other hand, when the operator frequently moves the blade of the dozer only vertically with the manually operable device 2, he or she sometimes covers the head portion 5*c* of the grip body 5 from above with his or her hand, or holds the head portion 5*c* for operation in order to increase a lever ratio while reducing an operating force.

The grip body 5 includes a ball-receiving surface or first surface B formed at a front side thereof (side that can be seen by the operator) and contacting the ball of the thumb, a palm-receiving surface or second surface C formed at a right side thereof and contacting the middle part of the palm and the base of the little finger, a finger-receiving surface or third surface D formed at a rear side thereof (side that cannot be seen by the operator; corresponding to a front side in the traveling direction of the machine) and contacting the fingers, and an open surface E formed at a left side thereof and positioned between the tips of the fingers and the ball of the thumb to be capable of receiving the thumb with the grip being held by the hand.

The ball of the thumb comes in contact with a lower part of the ball-receiving surface B of the grip body 5, while the thumb comes into contact with an upper part of the ball-receiving surface B when operating the switch 6. Part of the head portion 5*c* that corresponds to the upper part of the ball-receiving surface B is not spherical but cut away to allow the ball-receiving surface B to have a contour in horizontal cross section shifting from an arc projection at the lower part thereof to an arc recess at the upper part thereof.

The arc recess formed at the upper part of the ball-receiving surface B acts as a thumb-guiding portion Ba in the form of a shallow groove along which the inside of the first joint of the operator's thumb is placed. The thumb-guiding portion Ba is configured so that the bottom of the shallow groove is substantially flushed and continuous with a pivotal-point surface of a control element 6*a* of the seesaw-type switch 6.

With the upper part of the ball-receiving surface B being formed as the shallow groove having the arc recess, a larger area of the inside of the first and second joints of the operator's thumb is allowed to come in contact with the grip and to access the control element 6*a* of the switch 6 without giving the operator a sense of unevenness in the longitudinal direction at the inside of the first joint of the operator's thumb.

At the upper part of the ball-receiving surface B are formed risings between the thumb-guiding portion Ba and the open surface E and between the thumb-guiding portion Ba and the palm-receiving surface C to apply resistance when the operator's hand advances into the switch 6 (against a border violation beyond a switching operational range).

The risings include a first rising portion Bb formed between the thumb-guiding portion Ba and the open surface E, and a second rising portion Bc formed between the thumb-guiding portion Ba and the palm-receiving surface C.

The first rising portion Bb gradually bulges from the lower side to the upper side of the ball-receiving surface B to have the greatest height adjacent under the switch 6 and defines a first ridge L1 that is slightly inclined upward and laterally outward. The first rising portion Bb applies resistance to the operator's thumb when the thumb shifts from the open surface E to the thumb-guiding portion Bb to make the operator aware of a sense of overriding and shifting to the rising portion when the thumb is shifted consciously and aware of a sense of advancing into the rising portion when the thumb is shifted unconsciously, thereby preventing the thumb from inadvertently advancing into the rising portion.

The second rising portion Bc gradually bulges from the lower side to the upper side of the ball-receiving surface B to have the greatest height adjacent under the switch 6 and defines a second ridge L2 that is inclined upward and outward to a greater extent than the first ridge L1. When the operator grips the grip body 5 by the hand to cover the top portion A, in particular, the upper part of the ball of the thumb or the part between the ball of the thumb and the first finger may sometimes cover the switch 6. The second rising portion Bc serves to make the operator recognize that such parts of the hand are covering the switch and to call the operator's attention by giving resistance to the operator's hand in pressing the switch 6.

A distance between the first ridge L1 of the first rising portion Bb and the second ridge L2 of the second rising portion Bc is gradually increased from lower parts of the ridges toward the switch 6. The lower part of the second ridge L2 is curved sharply toward the thumb-guiding portion Ba to be fittingly held between the thumb and the second finger or first finger.

The first ridge L1 adjacent to the open surface E is in the form of a generally straight line while the second ridge L2 adjacent to the palm-receiving surface C is in the form of an outward bulging arc line extending laterally outside to a greater extent in the upper part than in the lower part of the ridge. The distance between the first ridge L1 and the second ridge L2 at the upper part is greater than a lateral width 6*w* of the control element 6*a* of the switch 6.

With this arrangement, the thumb-guiding portion Ba has a lateral width at the upper part thereof greater than at the lower part thereof. This allows the thumb to move laterally and press the control element 6*a* of the switch 6 sufficiently and reliably at the right or left side portion thereof even if the control element 6*a* is a wide seesaw type. Further, the sense of fittingness to the second ridge L2 at the lower part thereof between the thumb and the second finger or first finger can be improved.

A flat surface Aa is formed on the top portion A of the grip body 5 to surround the switch 6 and allow the control element 6*a* to be operated securely. A switch case 6*b* assumes a front-side upward oriented-inclining posture in which the surface (top surface) of the switch case 6*b* projects from the flat surface Aa to a greater extent at the front side thereof than at the near side of the operator, as a result of which the thumb placed on the thumb-guiding portion Ba is allowed to extend smoothly to the surface of the control element 6*a*.

The top portion A of the grip body 5 is formed to describe a generally spherical surface Ab around the flat surface Aa. The surface of the switch case 6*b* of the switch 6 is positioned within a globe of the generally spherical surface Ab (an imaginary globe shown in FIGS. 2 and 3).

When the grip 1 is pivotally operated back and forth more frequently than the switch 6 is operated, the operator sometimes holds the top portion A to make the palm face the switch 6. Even in such a state, the shape of the top portion A defined in the generally spherical surface Ab prevents the switch 6 from being inadvertently operated with the palm, with the additional help of the palm assuming a spherical recessed shape.

The grip body 5 has a lateral width that becomes gradually greater at the upper part than at the lower part thereof. The palm-receiving surface C has a middle portion receiving area Ca bulges from a little finger ball receiving area Cb to a great extent so that a distance R1 extending from the lateral center line S of the grip body 5 to the middle portion receiving area Ca is greater than a distance R2 extending from the center line S to the open surface E.

Thus, the grip body 5 is asymmetry in which the upper part of the palm-receiving surface C bulges laterally outward to a great extent so as to guide the operator's hand to the right position and allow the operator to easily hold the grip.

The finger-receiving surface D of the grip body 5 has an upper part bulging forward to a greater extent than a lower part thereof, and is provided with the push button 7 at the upper part thereof that is operable with the first finger or second finger. A fort portion Da is formed around the push button that has substantially the same height as a pressing surface 7*a* of the push button 7.

The fort portion Da has an arc shape (including a U shape and a mountain shape) that is opened downward to make it difficult to perform a pressing operation only by placing the first finger or second finer on the push button and to make the operator recognize the necessity of performing the pressing operation consciously with the tip of the first finger or second finger.

The lower part of the finger-receiving surface D is continuous with a lower part of the fort portion Da through a recessed arc surface Db. The recessed arc surface Db contacts the second finger when the push button 7 is operated with the first finger and contacts the third finger when the push button 7 is operated with the second finger to guide the hand holding the grip body 5 to the right position.

Although the fort portion Da may be formed over the entire circumference of the push button 7, the first finger or second finger can be moved toward the push button more closely during operation when the fort portion has the downward opening arc shape. This makes it possible for the operator's hand to be placed on the right position more appropriately and to hold the grip body 5 more easily.

The foot of the fort portion Da is continuous at an upper side and lateral opposite sides thereof with the upper part of the finger-receiving surface D through a gentle recessed arc surface so as to allow the first finger or second finger operating the push button 7 to move smoothly to the top of the fort portion Da.

In particular, the upper side of the fort portion Da is continuous with the generally spherical surface Ab of the top portion A through a gentle curved surface to have a shape for fittingly receiving the first finger so that the operator is free from a pain felt at the first finger that does not operate the push button while it is placed on the upper side of the fort portion or when a gripping force is applied to the first finger.

The grip 1 forms the gripping control portion 3 of the manually operable device 2 and is held by the right hand, for example. The grip body 5 has the head-bulb and trunk-circular shape and includes the ball-receiving surface B, the finger-receiving surface C and the open surface E. When performing a switching operation, the operator usually grips the trunk circular portion formed at the lower part of the grip body with the thumb, palm and fingers being rounded.

In this gripping state, the ball of the thumb contacts the ball-receiving surface B, the middle portion of the palm and the ball of the little finger contact the palm-receiving surface C, the remaining fingers contact the finger-receiving surface D, and the thumb, the ball of the thumb and the tips of the fingers reach the open surface E. That is, the grip body 5 is held substantially with the ball of the thumb, the third finger and little finger, while the thumb and the first finger or second finger is allowed to move away from the grip body 5 and to be freely movable for operating the switches.

The thumb-guiding portion Ba having the shallow groove is formed on the upper part of the ball-receiving surface B to elongate vertically. The operator is able to move his or her thumb away from the open surface E and move the inside of the first joint of the thumb along the thumb-guiding portion Ba to operate the switch 6 stably. The rising portion is formed on at least one of the portions between the thumb-guiding surface Ba and the open surface E and between the thumb-guiding surface Ba and the palm-receiving surface C for applying resistance when the thumb or the palm advances into the switch 6.

The first rising portion Bb formed between the thumb-guiding portion Ba and the open surface E serves to apply resistance when the thumb is inadvertently moved from the open surface E to the thumb-guiding portion Ba and the switch 6, and make the operator recognize that the switch 6 is operable. The second rising portion Bc formed between the thumb-guiding portion Ba and the palm-receiving portion C serves to apply resistance when the upper part of the palm or the base of the first finger covers the switch 6 and make the operator recognize that the switch 6 may be operated.

The first rising portion Bb also serves to apply resistance to prevent the thumb from being easily removed from the thumb-guiding portion Ba, while the second rising portion Bc promotes the possibility that the upper part of the palm is placed on the right position to allow the thumb to operate the switch 6 properly.

The distance between the first ridge L1 of the first rising portion Bb and the second ridge L2 of the second rising portion Bc is gradually increased from the lower parts of the ridges toward the switch 6 to become greater than the lateral width 6*w* of the control element 6*a* of the switch 6 at the upper part of the ridges. This allows the control element 6*a* of the seesaw-type switch 6 to be pressed with accuracy at either lateral side thereof.

When the switch 6 is operated with the operator's thumb being placed on the thumb-guiding portion Ba, the switch case 6*b* assumes the front-side upward oriented inclining posture in which its surface projects from the flat surface Aa of the top portion A of the grip body 5 to a greater extent at the front side thereof than at the near side of the operator, as a result of which the operator is able to perform a pressing operation smoothly at a position extending upward from the thumb-guiding portion Ba without bending the thumb hard.

When the operator hold the grip 1 with the switch 6 being covered with the upper part of the palm or the base of the first finger, the surface of the switch case 6*b* of the switch 6 is positioned within the globe of the generally spherical surface Ab forming the circumference of the flat surface Aa of the top portion A. As a result, the switch 6 is prevented from being inadvertently operated with the upper part of the palm or the base of the first finger.

The middle portion receiving area Ca of the palm-receiving surface C bulges from the little finger ball receiving area Cb and the distance R1 extending from the center line S to the middle portion receiving area Ca is greater than the distance R2 extending from the center line S to the open surface E. Thus, when the operator hold the grip 1 with the ball of the thumb, third finger and little finger, the position of the palm and the positions of the third finger and little finger are precisely determined and stably placed to hold the grip. This allows the operator to perform a switching operation with accuracy using the thumb, the first finger or the second finger.

The first finger or second finger of the hand holding the grip 1 operates the push button 7 provided in the finger-receiving surface D. The fort portion Da is formed around the push button 7 that has substantially the same height as the pressing surface 7*a* of the push button 7. This provides an environment that makes it difficult for the operator to perform a pressing operation unconsciously, and makes the operator recognize that he or she has to press the button with the finger tip beyond the fort portion Da, when necessary.

The fort portion Da has the arc shape to open downward with the lower part thereof being continuous with the lower part of the finger-receiving surface D through the recessed arc surface Db. This allows the first finger or second finger to be placed on the right position in operating the push button 7 only by placing the third finger or the second finger on the recessed arc surface Db.

It should be noted that the shapes of the elements described above and the fore-and-aft, lateral or vertical positional relationships in those elements are not limited to the arrangements shown in FIGS. 1 to 9, but the elements or arrangements can be variously modified and the combinations of the elements are variable.

For instance, the grip 1 can be used not only as the control lever for the dozer of the backhoe but also as a control lever for any other construction machinery such as a tractor or civil engineering machinery. The shape for right-hand use may be reversed to left-hand use.

Further, it is possible to dispense with the push button 7 and the fort portion Da of the grip 1 or to provide the switch 6 as a push-button type.

What is claimed is:

1. A grip comprising:

a grip body forming a gripping control portion of a device to be held with the operator's palm and fingers, the grip body including:

a head portion;

a trunk portion extending from the head portion and having a diameter smaller than a diameter of the head portion;

a first surface extending along a length of a front side of the head portion and the trunk portion, the first surface comprising a groove formed at an upper part thereof;

a second surface extending along a length of a first side of the head portion and the trunk portion;

a third surface extending along a length of a rear side of the head portion and the trunk portion;

an open surface extending along the length of a second side of the head portion and the trunk portion, the open surface positioned between the first surface and the third surface; and a switch mounted on the head portion of the grip body, wherein a first rising portion is formed between the groove and the open surface and a second rising portion is formed between the groove and the second surface, and wherein at least a portion of the groove is substantially flushed and continuous with a pivotal-point surface of a control element of the switch.

2. The grip as claimed in claim 1, wherein the switch is formed as a seesaw switch, and wherein a distance between a first ridge of the first rising portion and a second ridge of the second rising portion is gradually increased from lower parts of the ridges toward the switch.

3. The grip as claimed in claim 2, wherein the first ridge adjacent to the open surface is in the form of a straight line while the second ridge adjacent to the second surface is in the form of an outward bulging arc line extending laterally outside to a greater extent in an upper part than in a lower part of the second ridge.

4. The grip as claimed in claim 2, wherein the distance between the first ridge and the second ridge at an upper part thereof is greater than a lateral width of the switch.

5. The grip as claimed in claim 1, wherein a flat surface is formed on the head portion of the grip body to surround the switch, and wherein the switch includes a switch case that assumes a front-side upward oriented-inclining posture.

6. The grip as claimed in claim 5, wherein the head portion of the grip body includes an area defined around the flat surface to have a spherical surface, and wherein the switch case of the switch is positioned within a globe of the spherical surface.

7. The grip as claimed in claim 1, wherein the grip body has a lateral width that becomes gradually greater at the head portion than at the trunk portion, wherein the second surface has a middle portion receiving area that bulges, and wherein a distance extending from a lateral center line of the grip body to the middle portion receiving area is greater than a distance extending from the center line to the open surface.

8. The grip as claimed in claim 1, wherein the third surface of the grip body has an upper part bulging forward to a greater extent than a lower part thereof, and is provided with a push button at the upper part thereof, and wherein a fort portion is formed around the push button that has substantially the same height as a pressing surface of the push button.

9. The grip as claimed in claim 8, wherein the fort portion has an arc shape to open downward with a lower part thereof being continuous with the lower part of the third surface through a recessed arc surface.

10. The grip as claimed in claim 1, wherein the portion of the groove is a laterally intermediate part of the groove.

* * * * *